US005341757A

United States Patent [19]

Digiacomo

[11] Patent Number: 5,341,757

[45] Date of Patent: Aug. 30, 1994

[54] VERTICALLY ADJUSTING MOORING DEVICE

[76] Inventor: Don A. Digiacomo, 9131 SW. 122nd Ave., Apartment 5-105, Miami, Fla. 33186

[21] Appl. No.: 152,392

[22] Filed: Nov. 15, 1993

[51] Int. Cl.[5] ..... B63B 21/00

[52] U.S. Cl. ..... 114/230

[58] Field of Search ..... 114/230; 405/3

[56] References Cited

U.S. PATENT DOCUMENTS

| | | | |
|---|---|---|---|
| 1,259,762 | 3/1918 | McPartland | 405/3 X |
| 2,808,016 | 10/1957 | Jarnot | 114/230 |
| 2,837,712 | 2/1959 | Gossen | 114/230 |
| 2,990,803 | 4/1961 | Henderson | 114/230 |
| 3,001,371 | 9/1961 | Gilmore, Jr. et al. | 114/230 X |
| 3,122,120 | 2/1964 | Jorgenson | 114/230 |
| 3,842,779 | 10/1974 | Jaynes | 114/230 |
| 4,309,954 | 1/1982 | Szuch | 114/230 |
| 4,480,576 | 11/1984 | Mills | 114/230 |
| 4,923,336 | 5/1990 | Schmidt | 405/216 |
| 5,014,638 | 5/1991 | Ilves | 114/230 |
| 5,138,965 | 8/1992 | Culp | 114/230 |
| 5,265,553 | 11/1993 | Brydges | 114/230 |

*Primary Examiner*—Sherman Basinger
*Attorney, Agent, or Firm*—Leslie J. Lott & Assoc.

[57] ABSTRACT

A mooring device for automatically adjusting the vertical position of a floating object relative to the water level. The present invention provides a vertically adjusting mooring device for a floating object, comprising a pair of cables, each cable comprising an upper end and a lower end; the pair of cables are connected vertically along opposite sides of a dock post, whereby the cables are positioned substantially near the dock post; at least one pulley; the pulley is rotatably coupled to one of the cables for vertical movement between the upper end and the lower end of the cables; and the pulley is fastened to the floating object such that the pulley moves vertically in contact with the cable as the floating object moves vertically. In an alternative embodiment of the invention, the mooring device further comprises a spacer pulley to prevent the floating object from contacting the dock or cable when the floating object is moored on only one side. In a further alternative embodiment, the invention comprises a piling extender to increase the height of existing dock posts.

9 Claims, 10 Drawing Sheets

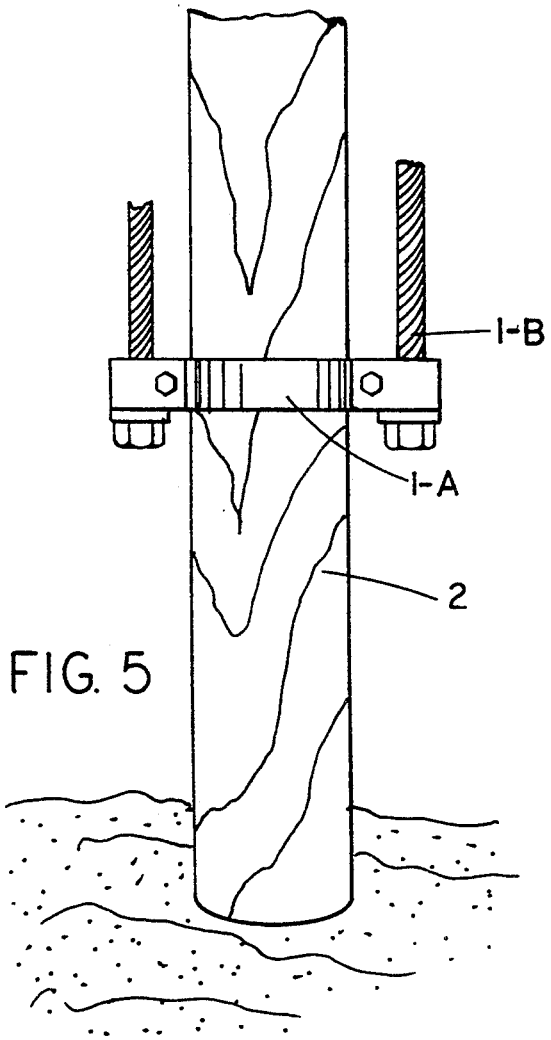
FIG. 5
FIG. 6B
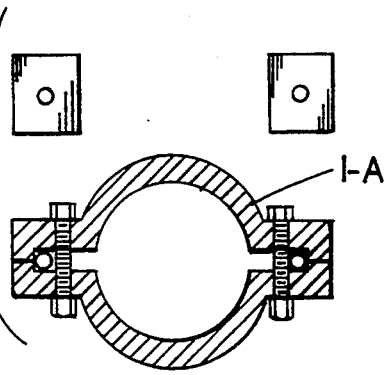
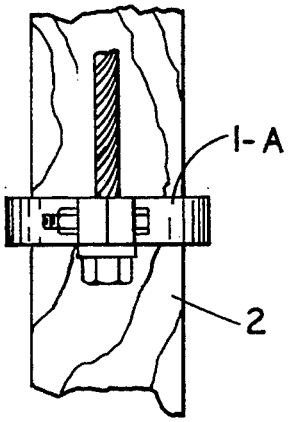
FIG. 6A
FIG. 6C
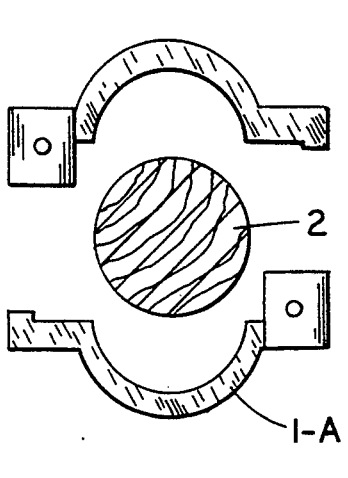

FIG. 8B
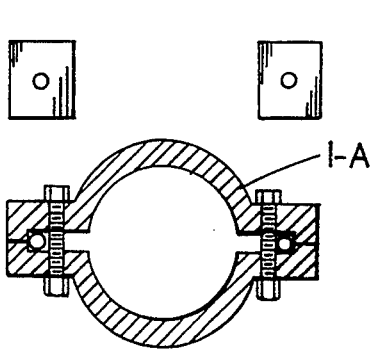
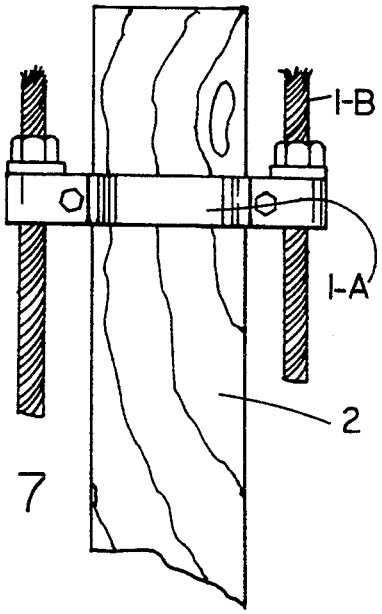
FIG. 7
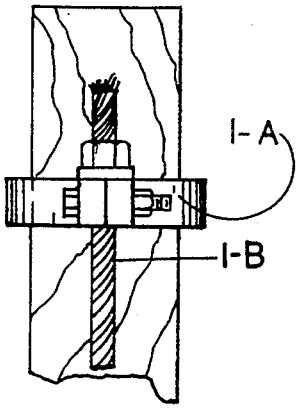
FIG. 8A
FIG. 8C
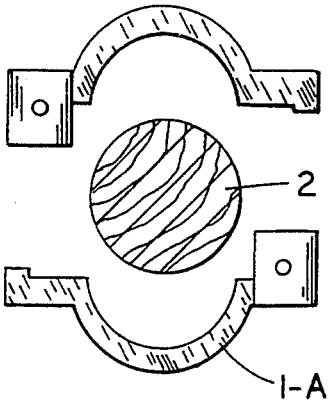

VERTICALLY ADJUSTING MOORING DEVICE

TECHNICAL FIELD

This invention relates generally to a mooring device, and this invention specifically relates to a protective mooring device for hazardous weather and/or water conditions which allows a floating object to automatically adjust within the mooring attachment with changing water levels.

BACKGROUND OF THE INVENTION

Extreme tidal changes are known to occur in waters throughout the world. The periodic rise and fall of the waters of the ocean and its inlets result from the attraction of the sun and moon. Flood waters, storms, and seasonal changes may also cause water level changes, not only in tidal bodies of water, but also in inland waters such as lakes, streams, and rivers. These changing water levels have always presented difficulties in mooring floating objects, such as boats, to a stationary land mass or artificial support.

Boaters often experiment with the length of the mooring lines to allow for these water level changes. However, by maintaining slack in these lines to allow vertical movement, the floating object is now free to move horizontally. Horizontal movement inevitably leads to damage to the floating object or to the object to which it is moored, such as the dock or pier.

Boaters often encounter differing tidal ranges from one geographic area to another, a factor which is needed to be taken into account when mooring. Other factors, although measurable and constant within a particular region, include the existence of "Spring Tides" and differing "flow rates" for bodies of water.

An attempt to remedy this mooring problem is illustrated in U.S. Pat. No. 5,138,965 to Culp and U.S. Pat. No. 5,014,638 to Ilves et al. each of which is incorporated herein by reference. Culp generally describes an improved water level compensation device for adjusting the vertical position of a floating object relative to a fixed land mass, comprising a first channel fixed to a land mass in a substantially vertical position with a carriage means movably retained within the channel and a second channel with a counterweight within to balance the weight of the carriage across a pulley. A coupling means, such as a trailer coupler, is affixed to a mounting plate affixed to the carriage for coupling the floating object relative to the fixed land mass. Ilves et al. generally describes a mooring construction having a fixed mount member on a boat, a vertically movable slider device on a dock post and a connecting unit, where the connecting unit includes a cylinder and piston to provide adjustability for the length of the connecting unit.

One major disadvantage associated with the type of system described in Culp is that the interior of the channels is exposed to the water and marine life, and after a period of time, the channels will become encrusted with marine life and other debris which will interfere with the ability of the carriage and counter-weight to move up and down within the confines of the channel. A further disadvantage is that since the channel and counter-weight configuration contains a multitude of moving parts in complex arrangement, the mooring device is subject to constant malfunction and breakage.

A similar disadvantage associated with the type of system described in Ilves et at. is that the vertical slider member having a tubular member mounted on a longer cylindrical guide is a complex system of interconnecting parts which, when any portion of the slider becomes encrusted with marine life or debris, the slider will no longer function.

A further disadvantage of both of the above-described systems is that the coupler described in the invention requires additional hardware mounted on the floating object, such as a trailer ball, which is not standard marine hardware.

Another type of mooring device is illustrated in U.S. Pat. No. 4,480,576 to Mills incorporated herein by reference. Mills generally describes a boat mooring arrangement in which a pair of cylindrical posts are affixed to the dock having carriage assemblies associated therewith comprising U-shaped collars having rollers which ride up and down the posts when the carriage assemblies are fastened to a boat when changes of water level are encountered. A major disadvantage of the system described in Mills is that in order to mount the posts, a tripod assembly is required to secure the posts to the dock. Such an assembly is oversized and cumbersome and requires a substantial amount of hardware in addition to the mooring site itself.

An additional type of mooring device is illustrated in U.S. Pat. No. 3,842,779 to Jaynes incorporated herein by reference. Jaynes generally describes a boat mooring device comprising a bow-shaped frame member with a cable attached thereto and with a slidable member supported of the cable and secured to a boat so that as the movement of the water causes the boat to move up and down, the slidable member will move correspondingly and prevent scuffing and damage to the boat. One major disadvantage associated with this type of system is that the bowed-shaped member is subject to high-stress and in time will bend, causing the cable to loosen and requiring replacement of the frame. Another disadvantage is that since the tubular member slidably supported on the cable is not equipped with any type of device for movement, it will have a tendency to bind due to friction or uneven stress points with every movement of the bow-shaped frame causing slackening of the cable.

An additional major disadvantage in all of the above-mentioned systems is that the systems do not provide any additional strengthening or enhancements to the existing dock posts or mooring site, and actually can cause extra stress on the side of attachment. Another disadvantage is that all of these systems require a substantial amount of additional hardware to be installed and operate. A further disadvantage is that none of these systems are designed to allow the greatest clearance in limited space, as in finger piers where the slips are narrow.

Another disadvantage is that none of the above-mentioned systems adequately address unpredictable severe natural conditions such as a possible change in factors such as "Spring Tides", nor do these systems address the collateral needs of environment, property, or public safety. Furthermore, none of these systems allow the maximum mooring height to be extended in the event conditions change.

One possible solution to these problems is to provide a mooring device which compensates for the changing water levels without requiring a substantial amount of additional hardware and can be easily installed onto existing dock posts.

Another possible solution to these problems is to provide a mooring device which does not interfere with the slip size by extending out over the water, nor does it interfere with the dock by extending onto the dock.

Another possible solution to these problems is to provide a mooring device that actually strengthens the dock post, and does not stress one side or the other, even when attached to a floating object during hazardous water and wind conditions.

Another possible solution to these problems is to provide a mooring device in which the vertical adjustment is not prone to failure due to marine growth or buildup and is easily serviced or replaceable when in need of repair.

Another possible solution to these problems is to provide a mooring device which can be easily extended to provide greater vertical adjustment and necessary strength during extreme tidal conditions, as during turbulent weather conditions, or hurricane season.

Thus, there has been a need in the art for a mooring device which compensates for the changing water levels which is economical, requires a minimal amount of additional hardware, and is easy to install onto existing dock posts, and in which the vertical adjustment mechanism, the only moving part, is not prone to failure due to marine growth or buildup and is easily replaceable without additional skill or training.

There has been an additional need in the art for a mooring device which is compact such that it does not interfere with the slip size by extending out over the water, nor does it interfere with the dock by extending onto the dock, and it provides a symmetrical cable-like support to strengthen the dock post.

There has been an additional need in the art for a mooring device which can be easily extended to provide greater vertical adjustment and greater protection during extreme wind, water, or tidal conditions.

SUMMARY OF THE INVENTION

The present invention solves significant problems in the art by providing a vertically adjusting mooring device for a floating object with the ability to maintain placement and sustain protection during extreme wind and water conditions.

Generally described, the present invention provides a vertically adjusting mooring device for a floating object comprising a pair of cables, each cable comprising an upper end and a lower end; means for connecting the pair of cables vertically along opposite sides of a dock post, whereby the cables are positioned substantially near the dock post; at least one pulley; means for rotatably coupling the pulley to one of the cables for vertical movement between the upper end and the lower end of the cables; and means for fastening the pulley to the floating object such that the pulley moves vertically in contact with the cable as the floating object moves vertically.

In a preferred embodiment of the invention, the dock post comprises a bottom end and a top end, the bottom end buried beneath the ground surface at a sufficient depth to support the dock post in a substantially vertical position. The upper end of each of the cables is connected to the dock post at a position above the surface of the water and the lower end of each of the cables is connected to the dock post at a position sufficiently above the ground surface to prevent the floating object from contacting the ground surface.

The means for connecting the cables to the dock posts comprises a top connecting bracket and a bottom connecting bracket, wherein each of the lower cable ends is threaded through the bottom bracket on opposite sides and secured by a cable head, and wherein each of the upper cable ends is threaded through the top connecting bracket and secured by a nut threaded onto the upper cable end.

The pulley comprises a housing, a roller mounted within the housing for engaging one of the pair of cables, a connecting link coupled to the housing for fastening the pulley to the floating object. The means for fastening the pulley to the floating object comprises a mooring line having a first end and a second end, wherein the first end of the mooring line is attached to the floating object and the second end of the mooring line attached to the connecting link of the pulley.

In an alternative embodiment of the invention, the dock post further comprises a piling extender attached to the top end of the dock post, whereby the piling extender increases the height of the dock post to a height greater than normal high tide level. The upper end of each of the cables is connected to the piling extender at a position above the surface of the water and the lower end of each of the cables is connected to the dock post at a position sufficiently above the ground surface to prevent the floating object from contacting the ground surface.

In another alternative embodiment of the invention, the mooring device further comprises a spacer pulley comprising a housing, a roller mounted within the housing for engaging one of the pair of cables, a connecting bracket coupled to the housing for directly fastening the pulley to the floating object, whereby the spacer pulley creates a barrier between the floating object and the cable.

Accordingly, it is an object of the present invention to provide a mooring device which compensates for the changing water levels comprising a pair of cables connected vertically along opposite sides of existing dock posts using minimal hardware.

It is another object of the present invention to provide a mooring device which does not interfere with the slip size by extending out over the water, nor does it interfere with the dock by extending onto the dock by using connecting brackets which secure the cables close to the dock post.

It is another object of the present invention to provide a mooring device that actually strengthens the dock post, and does not stress one side or the other by using a top connecting bracket and a bottom connecting bracket to connect a pair of cables, wherein each of the lower cable ends is threaded through the bottom bracket on opposite sides and secured by a cable head, and wherein each of the upper cable ends is threaded through the top connecting bracket and secured by a nut threaded onto the upper cable end.

It is another object of the present invention to provide a pulley system for vertical adjustment which inherently resists failure due to marine growth or buildup and is easily replaceable.

It is another object of the present invention to provide a mooring device which can be easily extended to provide greater vertical adjustment than with the existing dock posts by allowing the addition of piling extenders to the existing dock post and lengthening the cables of the mooring device.

It is another object of an alternative embodiment of the present invention to provide the dock post with a piling extender attached to the top end of the dock post, whereby the piling extender increases the height of the dock post to a height greater than normal high tide level. The upper end of each of the cables is connected to the piling extender at a position above the surface of the water at a height greater than normal high tide level and the lower end of each of the cables is connected to the dock post at a position sufficiently above the ground surface to prevent the floating object from contacting the ground surface.

It is another object of an alternative embodiment of the present invention to provide a spacer pulley comprising a housing, a roller mounted within the housing for engaging one of the pair of cables, a connecting bracket coupled to the housing for directly fastening the pulley to the floating object, whereby the spacer pulley creates a barrier between the floating object and the cable.

Accordingly, it is a feature of the invention to prevent the floating object from contacting the ground surface by connecting the lower end of each of the cables to the dock post at a position sufficiently above the ground surface to protect the ground surface as well as the floating object.

It is another feature of the invention to provide a pulley comprising a housing, a roller mounted within the housing for engaging one of the pair of cables, a connecting link coupled to the housing for fastening the pulley to the floating object, wherein a mooring line is attached between the floating object and the connecting link of the pulley.

An advantage of the invention is that the pulleys move freely along the length of the cables, regardless of stresses and conditions of wind or water, allowing the position of the floating object to adjust vertically with the water level, but restricting horizontal movement.

These and other objects, features, and advantages of the present invention may be more clearly understood and appreciated from a review of the following detailed description of the disclosed embodiments and by reference to the appended drawings and claims.

BRIEF DESCRIPTION OF THE DRAWING FIGURES

FIG. 5 is a view of the bottom cable bracket of the preferred embodiment of the mooring device according to the invention, showing its placement above the seabed into which a dock post is sunken.

FIGS. 6A, 6B and 6C are views of the components of the bracket of the preferred embodiment of the mooring device according to the invention, showing attachment to the dock post.

FIG. 7 is a view of the top cable bracket of the preferred embodiment of the mooring device according to the invention, showing its placement at the top of the dock post.

FIGS. 8A, 8B and 8C are further views of the components of the top cable bracket of the preferred embodiment of the mooring device according to the invention, showing the upper cable end and tensioning nut.

DETAILED DESCRIPTION OF THE PREFERRED EMBODIMENT

Figure 1:
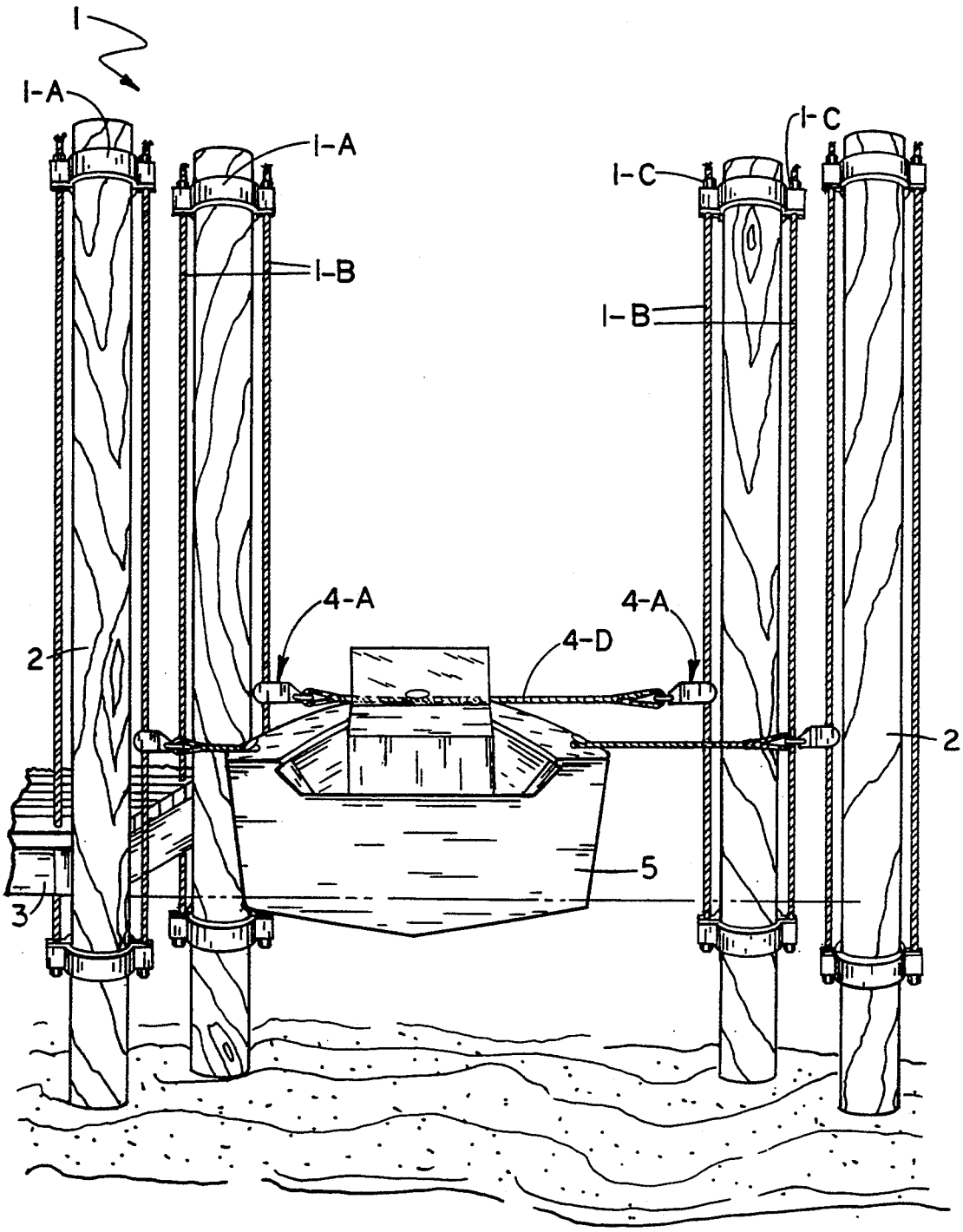
FIG. 1 is a plan view of a preferred embodiment of the mooring device according to the invention, depicting a mooring during high tide.

Referring initially to FIG. 1 of the drawings, in which like numerals indicate like elements throughout the several views, in a preferred embodiment the mooring device of this invention is generally illustrated by reference numeral 1. The mooring device 1 is shown attached to a dock post 2 associated with an existing dock 3. The bottom end of the dock post 2 is preferably buried beneath the seabed at a sufficient depth to support the dock post in a substantially vertical position. The top end of the dock post 2 extends above the water surface at a height equal to or greater than the highest expected tidal level. A floating object 5, such as a boat, buoy, floating dock, or the like, is moored to the mooring device 1 using mooring lines 4-*d* (FIG. 5) or other suitable mooring means, such as a cable, rope, or chain.

Figure 2:
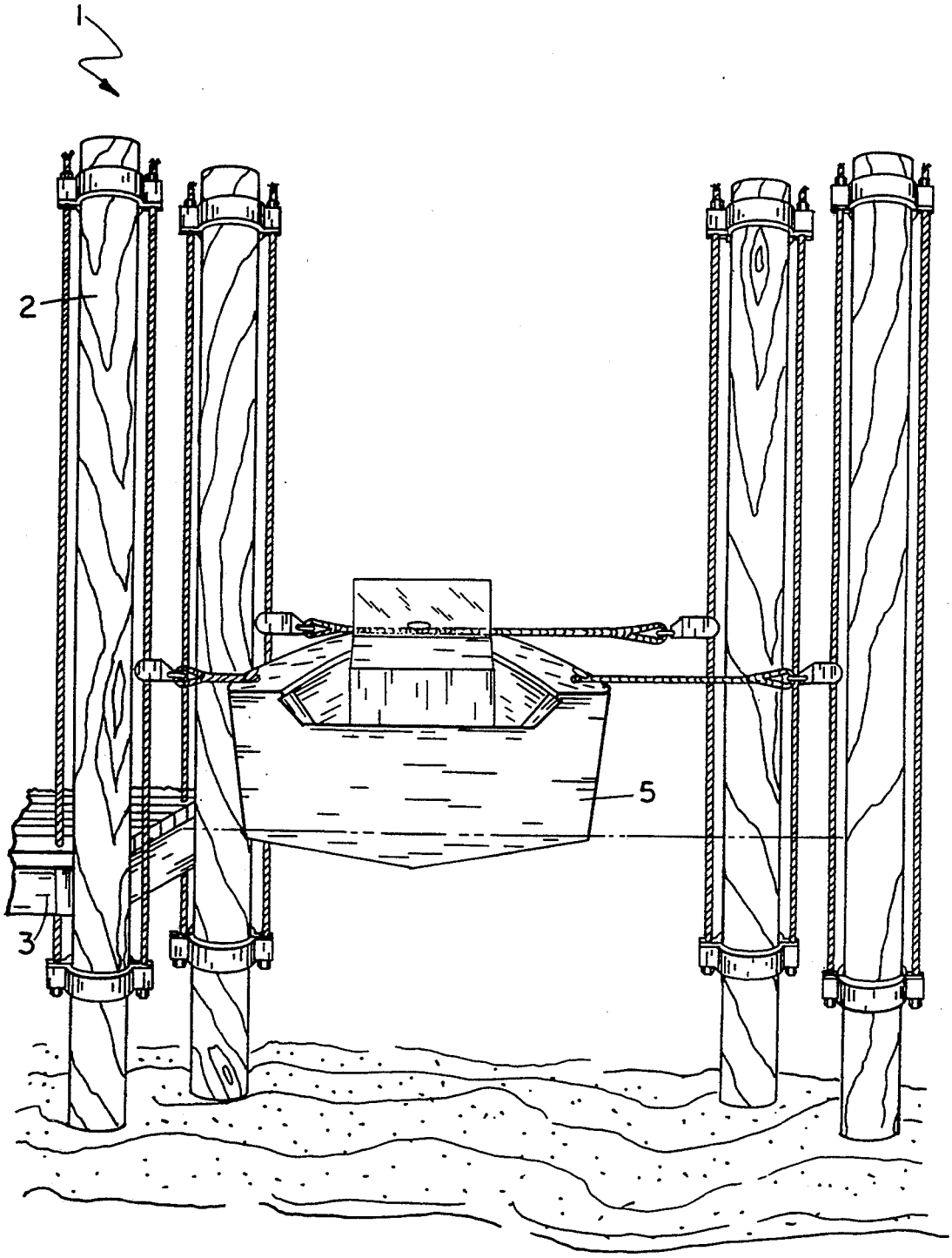
FIG. 2 is a plan view of a preferred embodiment of the mooring device according to the invention, depicting a mooring during spring tide.
Figure 3:
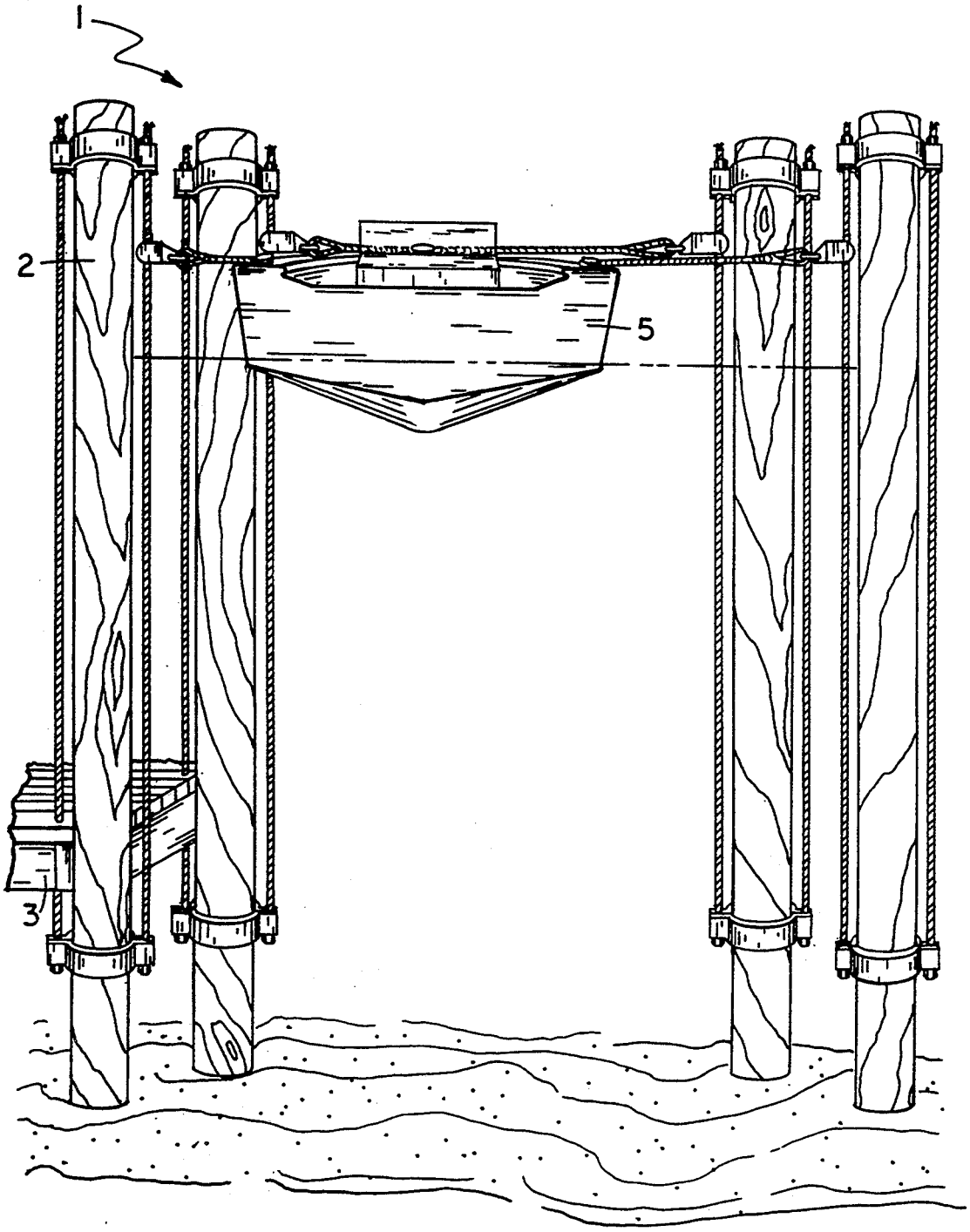
FIG. 3 is a plan view of a preferred embodiment of the mooring device according to the invention, depicting a mooring during storm surge levels of sixteen feet.

FIGS. 1 through 3 illustrate various water levels encountered by mooring devices. FIG. 1 shows the operation of the mooring device during high tide. FIG. 2 illustrates the operation of the mooring device during spring tides. Finally, FIG. 3 shows the operation of the mooring device during a storm surge.

The mooring device 1 comprises a pair of cables 1-*b* running vertically along opposite sides of the dock post 2 and secured to the dock post 2 above the water's surface and beneath. In a preferred embodiment of the invention, the upper ends of the cables 1-*b* are secured at the top of the dock post 2, at a position greater than the maximum storm surge or flood water level for the particular region. The lower ends of the cables 1-*b* are secured at a sufficient position above the seabed to prevent the floating object 5 from contacting the seabed during extreme low-tides or during turbulent conditions when wave action creates extremely shallow points. The lower ends of the cables 1-*b* usually remain beneath the water surface.

Figure 4:
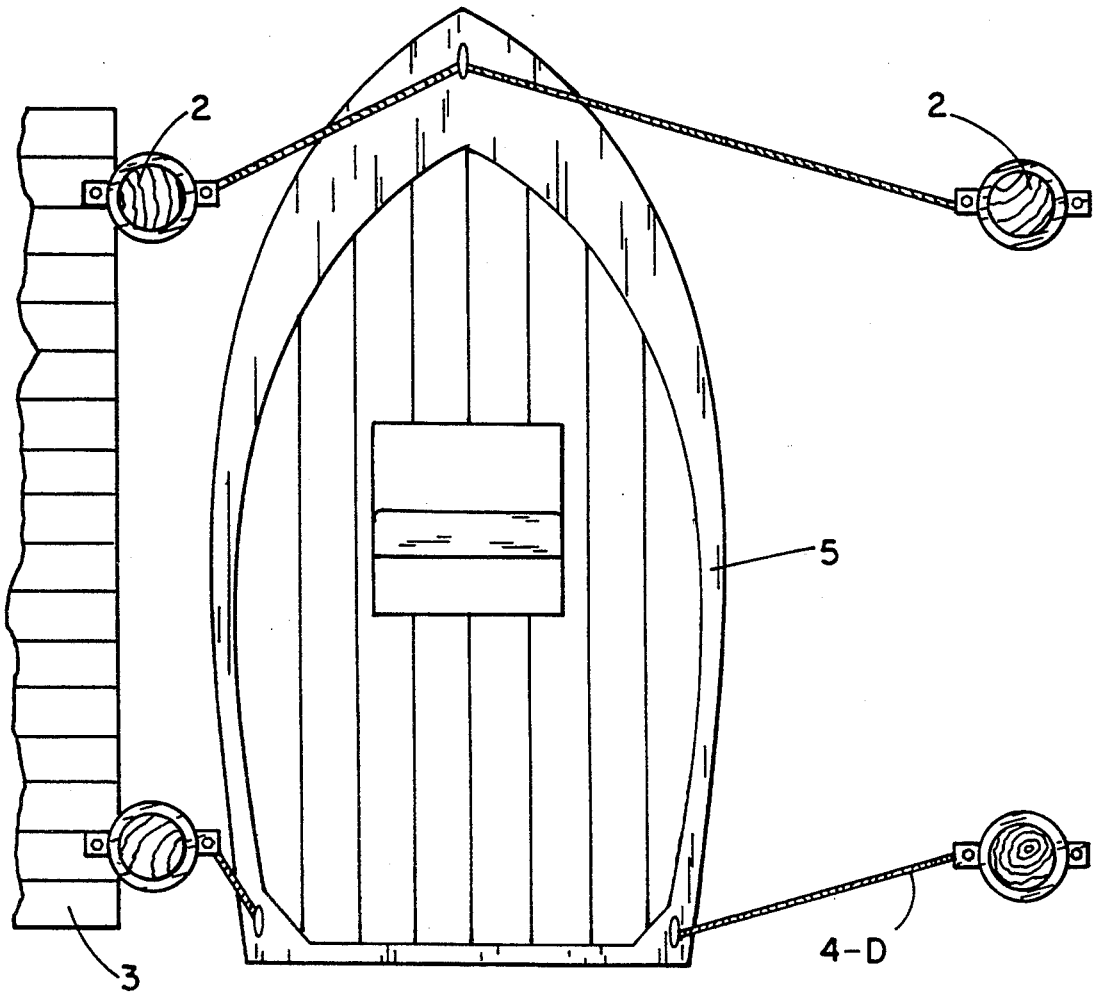
FIG. 4 is a top view of the preferred mooring arrangement of the invention.

As shown in FIG. 1, the preferred mooring position of the invention includes four dock posts 2 each with a mooring device 1. The dock posts 2 are positioned in the four corners of a substantially rectangular area, such as a boat slip, such that the floating object 5 can be moored within this boat slip with mooring lines 4-*d* attached to each mooring device 1. The boat slip should conform to proper dock or vessel ratios when moored. FIG. 4 shows a top view of this preferred mooring position, with the floating object 5 located within the boat slip. One end of each mooring line 4-*d* is secured to the floating object 5 by means of a cleat, hook, or any other established tie-off hardware installed within the industry. The opposite end of each mooring line 4-*d* is connected to one of the pair of cables 1-*b* secured to each dock post 2. Although FIG. 4 illustrates the preferred mooring arrangement of the invention, a plurality of mooring arrangements using various numbers of dock posts 2 with mooring devices 1 are contemplated, and are discussed in more detail below with reference to the alternative embodiments of the invention.

Turning now to FIGS. 5 through 8, the preferred means for securing the cables 1-*b* to the dock post 2 are illustrated. A bottom cable bracket 1-*a* is attached to the dock post 2 at a position above the seabed. (FIGS. 5 and 6). The bottom cable bracket 1-*a* holds the bottom ends of the pair of cables 1-*b* on opposite sides of the dock post 2. The cables 1-*b* are held sufficiently close to the dock post 2 so as to not extend in the way of the dock 3 or the boat slip area. In a preferred embodiment, bottom cable heads are located on each of the bottom ends of the pair of cables 1-*b* respectively to prevent the pair of cables 1-*b* from slipping through the bottom cable bracket 1-*a*.

The top cable bracket 1-*a* is attached near the top end of the dock post 2 at a position greater than or equal to the maximum expected high-tide water level for the particular region or possible condition. (FIGS. 7 and 8). The threaded top ends of the cables 1-*b* are inserted through the top cable bracket 1-*a* and secured by tensioning bolts 1-*c*. The tensioning bolts 1-*c* are used to adjust the tension of the cables 1-*b* , while holding the top ends of the cables 1-*b* in place. The cables 1-*b* provide added strength to the dock post 2 when tightened on both sides. The use of the cables 1-*b* on both sides prevents added stress toward only one side. The cables 1-*b* are positioned close to the dock post 2 to allow a compact, thus strengthening, mooring means, without interfering with the dock area or slip area.

Figure 10:
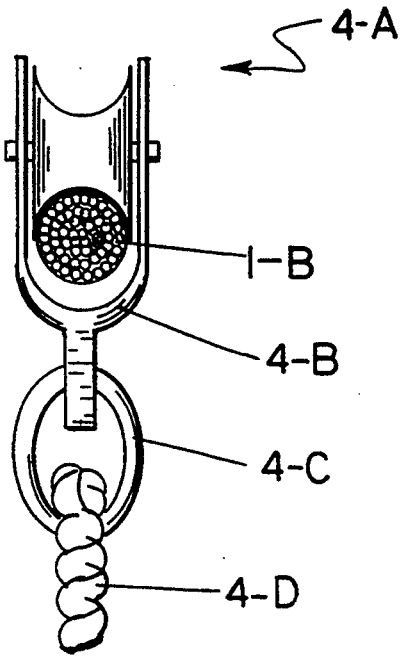
FIG. 10 is a top sectional view of the pulley of the preferred embodiment of the mooring device according to the invention showing the pulley roller inside.
Figure 9:
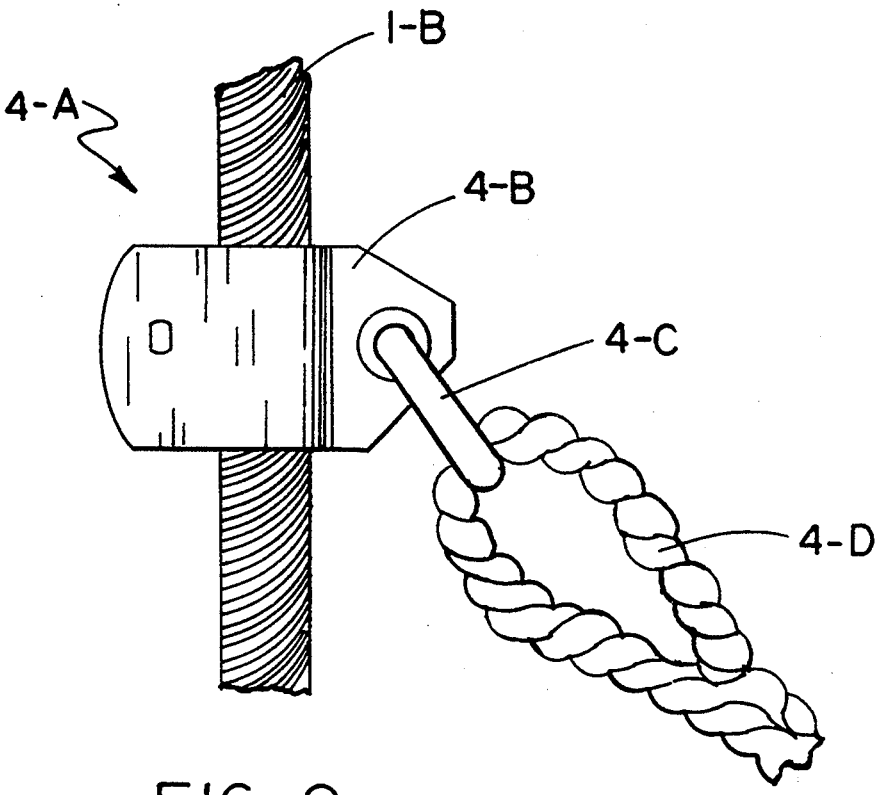
FIG. 9 is a side sectional view of the pulley on the cable of the preferred embodiment of the mooring device according to the invention showing the connecting link and mooring line.

Turning now to FIGS. 9 and 10, a pulley 4-*a* of the preferred embodiment of the mooring device with respect to one of the cables 1-*b* is shown. Prior to securing the cable 1-*b* to the top cable bracket 1-*a*, the cable 1-*b* is inserted through the pulley 4-*a*. The pulley 4-*a* is designed to ride up and down the length of the cable 1-*b* between the two cable brackets 1-*a* , 1-*a* . The cable 1-*b* rides along a roller within the pulley bracket 4-*b* to ease vertical movement. The pulley bracket 4-*b* is attached to the mooring line 4-*d* by means of a connecting link 4-*c*. The connecting link 4-*c* may consist of a ring, hook, quick-release locking ring, or other suitable linking means to connect the mooring line 4-*d* to the pulley bracket 4-*b*.

The operation of the mooring device 1 is hereafter described with respect to FIGS. 1, 2, and 3. When a floating object 5, such as a boat, is to be moored, the floating object 5 is positioned between three or more dock posts 2, preferably two or more dock posts 2 on each side of the floating object 5, with one fore and one aft of the floating object 5. Alternate arrangements, such as using more or less than four dock posts for mooring a floating object is also contemplated, for instance, using three dock posts 2 located in a triangular relationship. The floating object 5, may be positioned nearer one side for ease of entry and exit. One end of each of the mooring lines 4-*d* is attached to a corresponding connecting link 4-*c* of the pulley bracket 4-*b* on each of the dock posts 2. The other end of each of the mooring lines 4-*d* is attached to the floating object 5 in standard maritime practices without slack in the lines 4-*d*. When the tide rises, the floating object will rise correspondingly with the water level. The mooring lines 4-*d* connected to the pulley bracket 4-*b*, will cause the pulleys 4-*a* to move vertically along the cables 1-*b*. When the tide lowers, the floating object 5 will lower with the water level. The mooring lines 4-*d* will remain connected to the pulley bracket 4-*b* which ride down the cables 1-*b* with the water level. The mooring device 1 allows the floating object 5 to remain attached to the dock posts 2 without regard for storm or tidal surge conditions, inclusive of wind.

Figure 11:
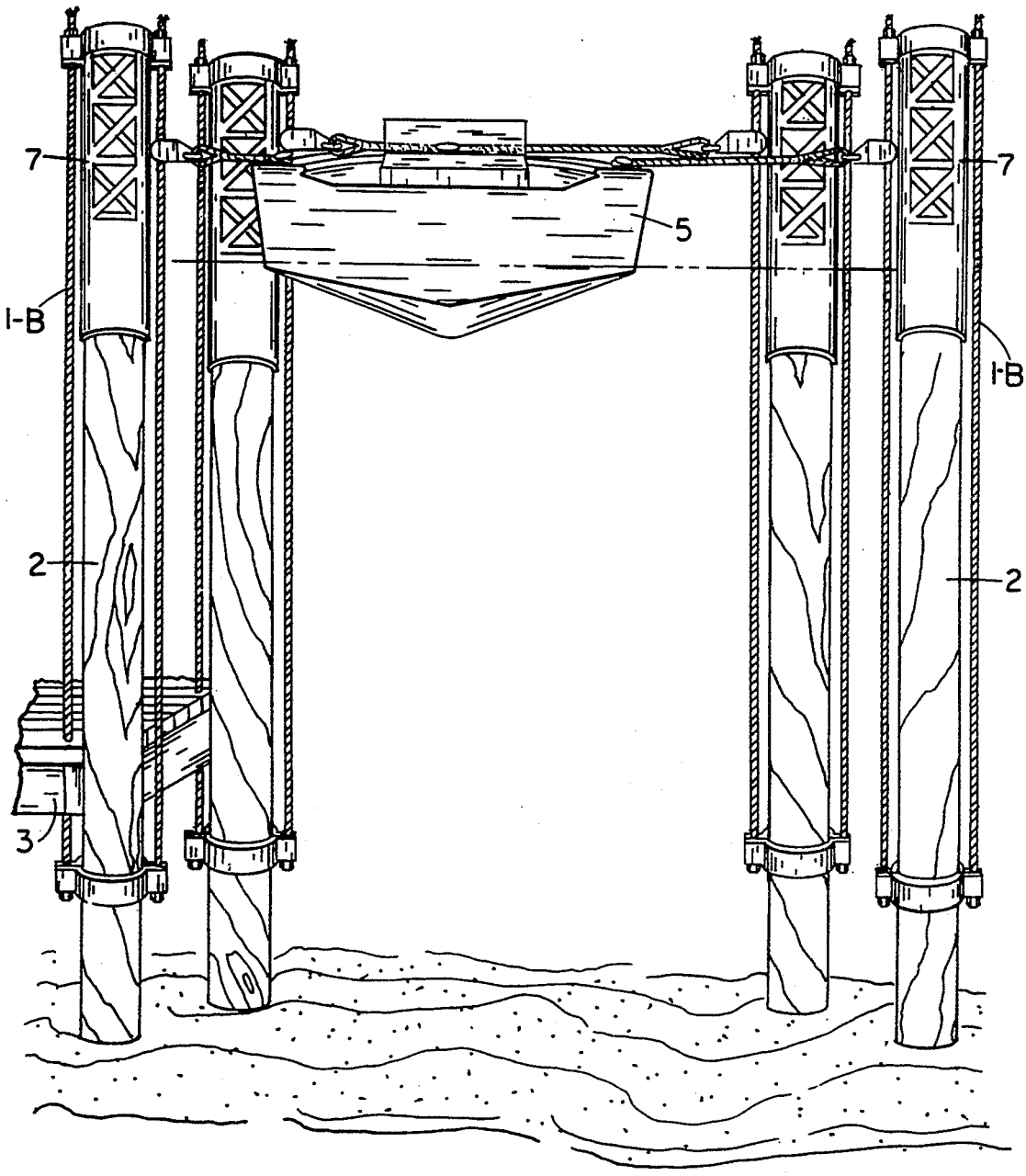
FIG. 11 is a plan view of the piling extender mounted over an existing dock post in an alternate embodiment of the mooring device according to the invention showing a floating object moored during storm surge levels of sixteen feet.
Figure 12:
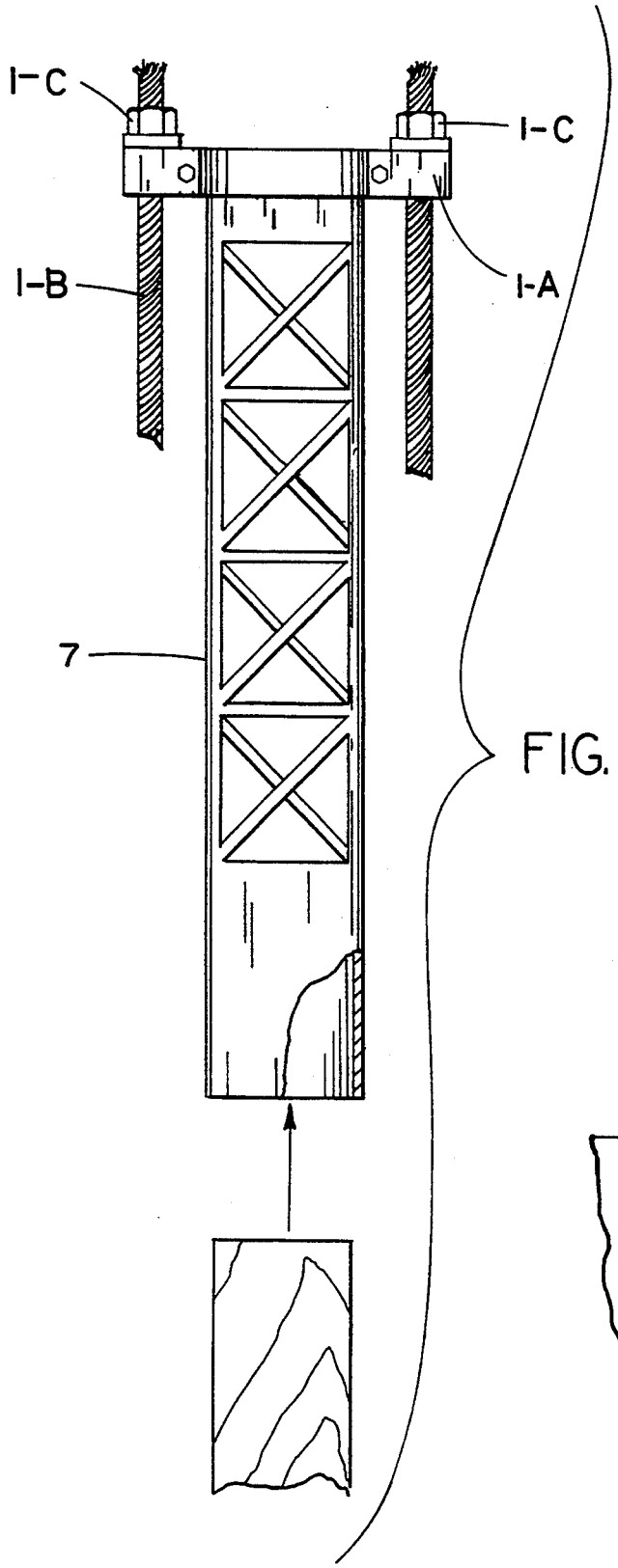
FIG. 12 is a sectional view of the piling extender as it is being mounted on an existing dock post in an alternate embodiment of the mooring device according to the invention.
Figure 13:
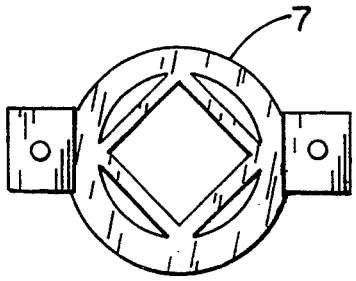
FIG. 13 is a top view of the piling extender incorporating the top bracket therein in an alternate embodiment of the mooring device according to the invention.

In an alternative embodiment of the invention, FIGS. 11 through 13 show piling extenders 7 attached to the upper ends of the dock posts 2 in order to extend the height of the dock posts 2 when used with the invention. In some situations, the height of an existing dock post 2 may be less than the maximum highest water level for the particular region or condition. The piling extenders 7 would increase the height of the existing dock post 2 to allow for the hazardous weather conditions. During certain seasons such as hurricane or monsoon season, it may be desirable to readily extend the dock posts 2 and seek out the mooring device 1 when storm surges may cause high-tide levels to be greater than usual and wind conditions become hazardous.

FIG. 12 shows the piling extenders 7 attached to the top of an existing dock post 2. The top end of the piling extender 7 includes a bracket portion eliminating the need for the bracket (FIG. 13). The threaded upper ends of the cables 1-*b* are inserted through the bracket portion of the piling extender and secured by tensioning bolts 1-*c*. The tensioning bolts 1-*c* are used to adjust the tension of the cables 1-*b*, while holding the upper ends of the cables 1-*b* in place. The cables 1-*b* provide added strength to the piling extender 7 and dock post 2 when tightened on both sides. The use of the cables 1-*b* on both sides prevents added stress toward only one side.

Figure 14:
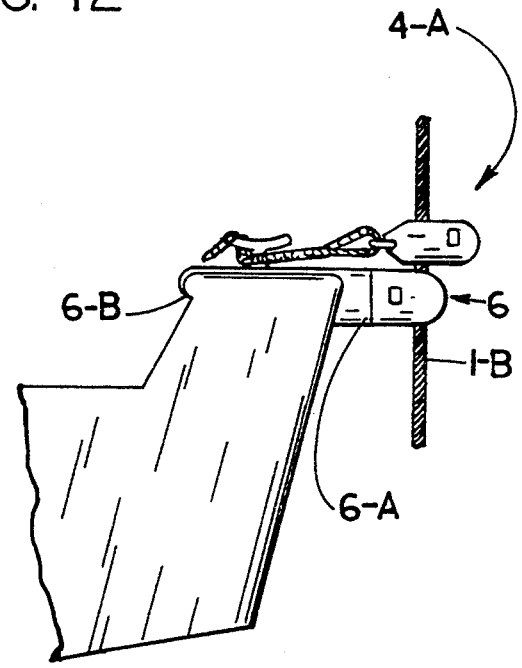
FIG. 14 is a sectional view of a floating object with the spacer pulley in place and its relationship to the cable and the cable pulley in an alternate embodiment of the mooring device according to the invention.
Figure 16:
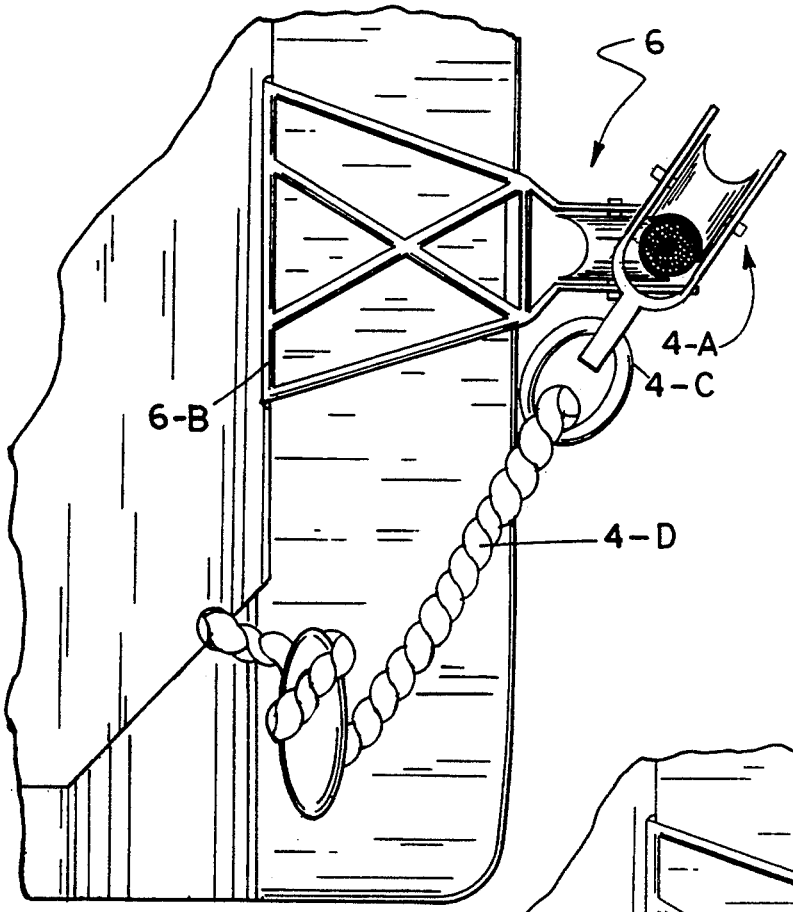
FIG. 16 is a top view of the spacer pulley and the cable pulley while the floating object is being moored in an alternate embodiment of the mooring device according to the invention.
Figure 15:
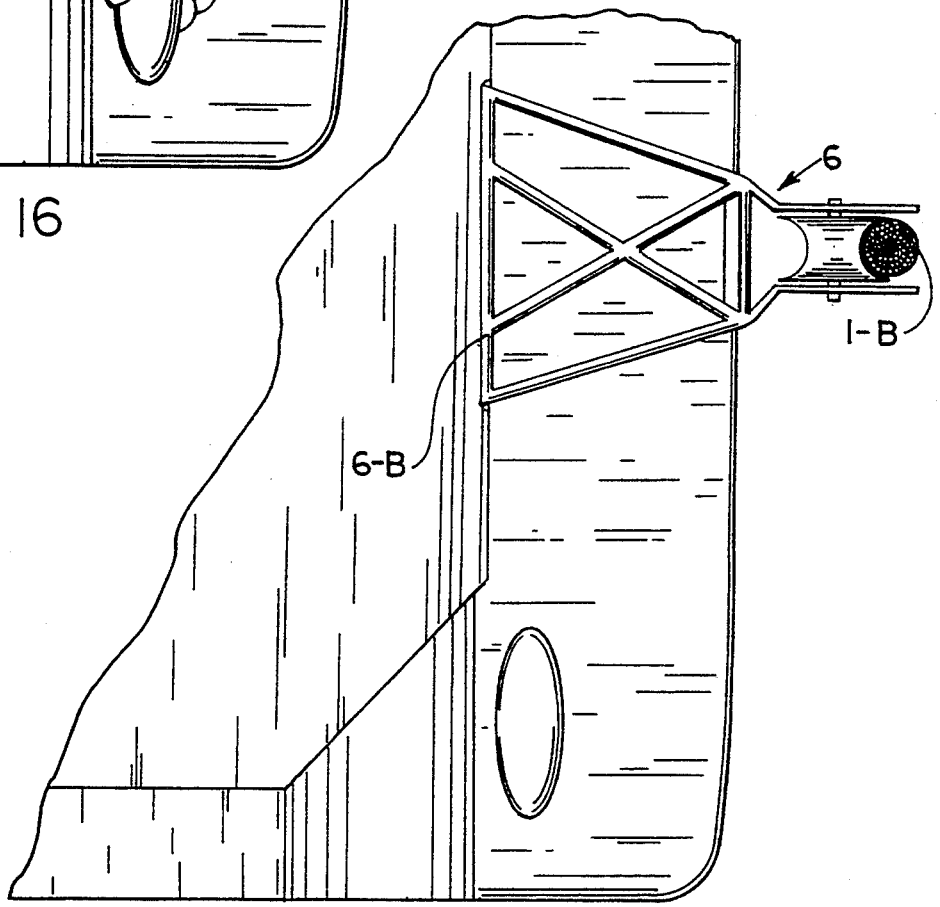
FIG. 15 is a top view of the spacer pulley showing its relationship to the floating object when moored in an alternate embodiment of the mooring device according to the invention.

FIGS. 14 through 16 show the use of a spacer pulley 6 on one of the cables 1-*b* in an alternative embodiment of the mooring device according to the invention. Although the preferred mooring position includes three or more dock posts 2 as shown in FIGS. 1, 2 and 3, situations may arise when only two posts 2 are available. In order to prevent the floating object 5 from drifting into the cables 1-*b*, dock posts 2 or dock 3 when one side of the floating object 5 is moored with the pulleys 4-*a* as described above with respect to FIGS. 9 and 10 to only two dock posts, a spacer pulley 6 is positioned between the floating object 5 and each of the cables 1-*b* forming a channeled barrier. One end of the spacer pulley **6-*a* is connected to the floating object 5 by a connecting means 6-*b* such as a clamp, bracket, or the like. FIG. 15 shows a top view of the connecting means 6-*b* attached to the floating object 5. The floating object 5 is positioned such that the cable 1-*b* is in contact with the spacer pulley 6-*a* on the outside away from the floating object 5. The spacer pulley 6-*a* and the cable pulley 4-*a* are free to move vertically the length of the cable, while preventing the floating object 5 from contacting the cables, dock posts, or dock. FIG. 16 is a top view showing the spacer pulley 6-*a* in relation to the cable and the cable pulley 4-*a*. The mooring line connected to the cable pulley 4-*a* is tightened to keep the spacer pulley 6-*a* in contact with the cable. The spacer pulley 6-*a*** creates a barrier between the floating object and the cable, preventing damage to the dock, and restricting horizontal movement.

Accordingly, it will be understood that the preferred embodiment and alternative embodiment of the present invention have been disclosed by way of example and that other modifications and alterations may occur to those skilled in the art without departing from the scope and spirit of the appended claims.

What is claimed is:

1. A vertically adjusting mooring device for a floating object, comprising:

(a) a pair of cables, each cable comprising an upper end and a lower end;

(b) means for connecting said pair of cables vertically along opposite sides of a dock post, said upper end of each of said cables is connected to said dock post at a position above the surface of the water and said lower end of each of said cables is connected to said dock post at a position sufficiently above the ground surface to prevent said floating object from contacting the ground surface, whereby said cables are positioned substantially near said dock post; and wherein said means for connecting said cables to said dock post comprises a top connecting bracket and a bottom connecting bracket, wherein each of said lower cable ends is threaded through said bottom bracket on opposite sides and secured by a cable head, and wherein each of said upper cable ends is threaded through said top connecting bracket and secured by a nut threaded onto said upper cable end;

(c) at least one pulley;

(d) means for rotatably coupling said pulley to one of said cables for vertical movement between said upper end and said lower end of said cables; and (e) means for fastening said pulley to said floating object such that said pulley moves vertically in contact with said cable as said floating object moves vertically.

2. The mooring device of claim 1 wherein said dock post comprises a bottom end and a top end, said bottom end buried beneath the ground surface at a sufficient depth to support said dock post in a substantially vertical position.

3. The mooring device of claim 2 wherein said dock post further comprises a piling extender attached to said top end of said dock post, whereby said piling extender increases the height of said dock post.

4. The mooring device of claim 3 wherein said upper end of each of said cables is connected to said piling extender at a position above the surface of the water and said lower end of each of said cables is connected to said dock post at a position sufficiently above the ground surface to prevent said floating object from contacting the ground surface.

5. The mooring device of claim 1 wherein said pulley comprises a housing, a roller mounted within said housing for engaging one of said pair of cables, a connecting link coupled to said housing for fastening said pulley to said floating object.

6. The mooring device of claim 5 wherein said means for fastening said pulley to said floating object comprises a mooring line having a first end and a second end, wherein said first end of said mooring line is attached to said floating object and said second end of said mooring line is attached to said connecting link of said pulley.

7. The mooring device of claim 1 further comprising a spacer pulley comprising a housing, a roller mounted within said housing for engaging one of said pair of cables, a connecting bracket coupled to said housing for directly fastening said pulley to said floating object, whereby said spacer pulley creates a barrier between said floating object and said cable.

8. A vertically adjusting mooring device for a floating object, comprising:

a pair of cables, each cable comprising an upper end and a lower end;

means for connecting said pair of cables vertically along opposite sides of a dock post, whereby said cables are positioned substantially near said dock post, wherein said upper end of each of said cables is connected to said dock post at a position above the surface of the water and said lower end of each of said cables is connected to said dock post at a position sufficiently above the ground surface to prevent said floating object from contacting the ground surface, and wherein said means for connecting said cables to said dock post comprises a top connecting bracket and a bottom connecting bracket, wherein each of said lower cable ends is threaded through said bottom bracket on opposite sides and secured by a cable head, and wherein each of said upper cable ends is threaded through said top connecting bracket and secured by a nut threaded onto said upper cable end;

at least one pulley, wherein said pulley comprises a housing, a roller mounted within said housing for engaging one of said pair of cables, a connecting link coupled to said housing for fastening said pulley to said floating object;

means for rotatably coupling said pulley to one of said cables for vertical movement between said upper end and said lower end of said cables; and a means for fastening said pulley to said floating object comprising a mooring line having a first end and a second end, wherein said first end of said mooring line is attached to said floating object and said second end of said mooring line attached to said connecting link of said pulley such that said pulley moves vertically in contact with said cable as said floating object moves vertically.

9. A vertically adjusting mooring device for a floating object, comprising:

a piling extender secured to an existing dock post;

a pair of cables, each cable comprising an upper end and a lower end;

means for connecting said pair of cables vertically along opposite sides of said dock post, said upper end of each of said cables is connected to said dock post at a position above the surface of the water and said lower end of each of said cables is connected to said dock post at a position sufficiently above the ground surface to prevent said floating object from contacting the ground surface, whereby said cables are positioned substantially near said dock post; and wherein said means for connecting said cables to said dock post comprises a top connecting bracket and a bottom connecting bracket, wherein each of said lower cable ends is threaded through said bottom bracket on opposite sides and secured by a cable head, and wherein each of said upper cable ends is threaded through said top connecting bracket and secured by a nut threaded onto said upper cable end;

at least one pulley;

means for rotatably coupling said pulley to one of said cables for vertical movement between said upper end and said lower end of said cables; and a means for fastening said pulley to said floating object such that said pulley moves vertically in contact with said cable as said floating object moves vertically.

* * * * *